US006719228B2

(12) United States Patent
Berger et al.

(10) Patent No.: US 6,719,228 B2
(45) Date of Patent: Apr. 13, 2004

(54) BAFFLE FOR A FOOD WASTE DISPOSER TO REDUCE NOISE AND ASSOCIATED METHODS

(75) Inventors: Thomas R. Berger, Racine, WI (US); Cynthia Jara-Almonte, Kenosha, WI (US)

(73) Assignee: Emerson Electric Company, St. Louis, MD (US)

( * ) Notice: Subject to any disclaimer, the term of this patent is extended or adjusted under 35 U.S.C. 154(b) by 0 days.

(21) Appl. No.: 10/066,893

(22) Filed: Feb. 4, 2002

(65) Prior Publication Data

US 2002/0104908 A1 Aug. 8, 2002

Related U.S. Application Data

(60) Provisional application No. 60/266,621, filed on Feb. 6, 2001.

(51) Int. Cl.[7] ..... B02C 18/42
(52) U.S. Cl. ..... 241/46.016
(58) Field of Search ..... 241/46.013, 46.014, 241/46.015, 46.016

(56) References Cited

U.S. PATENT DOCUMENTS

| | | | | |
|---|---|---|---|---|
| 2,834,554 A | * | 5/1958 | Bebinger | 241/46.016 |
| 2,896,866 A | | 7/1959 | Hyde | 241/100.5 |
| 3,025,007 A | | 3/1962 | Wieczorek | 241/100.5 |
| 3,071,328 A | | 1/1963 | Higer | 241/46 |
| 3,432,108 A | | 3/1969 | Enright | 241/100 |
| 3,524,596 A | * | 8/1970 | Smith | 241/46.016 |
| 4,253,616 A | * | 3/1981 | Timmer | 241/46.016 |

OTHER PUBLICATIONS

Marketing Brochure for Japanese Waste Disposal Unit manufactured by Toto, Ltd. of Japan; Feb., 1999.

* cited by examiner

*Primary Examiner*—Mark Rosenbaum
(74) *Attorney, Agent, or Firm*—Howrey Simon Arnold & White LLP

(57) ABSTRACT

A baffle for a food waste disposer to reduce noise is disclosed. The baffle has a diaphragm that allows solid and liquid waste to pass through the diaphragm, and accordingly does not substantially affect the normal operation of the disposer. However, because the baffle covers the central opening in the conventional mounting gasket of the prior art, a direct path from the grinding mechanism in the disposer to the sink is blocked, thus muffling the noise coming from the grinding mechanism. Additionally, the disclosed baffles are preferably, but not necessarily, designed so as to create a water dam on their surface by impeding the flow of water from the sink faucet in a way to create a pool of water. The disclosed baffles may be installed in the drain opening of a sink above the conventional mounting gasket, although other embodiments are also disclosed.

33 Claims, 10 Drawing Sheets

BAFFLE FOR A FOOD WASTE DISPOSER TO REDUCE NOISE AND ASSOCIATED METHODS

CROSS-REFERENCE TO RELATED APPLICATIONS

This application claims the benefit of the Provisional Application Serial No. 60/266,621 filed Feb. 6, 2001, which is hereby incorporated by reference in its entirety.

FIELD OF THE INVENTION

The present invention relates generally to food waste disposers, and more particularly to a baffle for a food waste disposer to reduce noise.

BACKGROUND OF THE INVENTION

Conventional food waste disposers produce noise during operation. This is due, in part, by the operation of the motor as well as the by the food impacting against the disposer body and grind components. To reduce noise, it has been known to place an insulating cover around the exterior housing of the disposer. An exterior cover, however, does not prevent noise from traveling up through a drain opening of a sink where it can easily be heard by the user of the food waste disposer.

It has also been known to use a mounting gasket between the disposer inlet and the drain opening. One function of the mounting gasket is to keep food waste from getting "kicked back" up through the drain opening when the disposer is operating. FIG. 1 depicts a food waste disposer 10 having a conventional mounting gasket 50. The food waste disposer 10 has an inlet portion 12 that connects to a sink 20 and drain opening 22. The inlet portion 12 of the disposer 10 is connected to the sink 20 and drain opening 22 via a connecting apparatus 40 and the mounting gasket 50. Although different mechanisms exist, one type of connecting apparatus is described in U.S. Pat. No. 3,025,007, which is owned by the assignee of the present application and incorporated herein by reference in its entirety.

The mounting gasket 50, shown in more detail in FIGS. 2A–C, has an outer seal portion 52 and a pleated portion 54. The outer seal portion 52 provides a seal between the connecting apparatus 40 and the inlet portion 12 of the disposer 10. The pleated portion 54 has surfaces 55, 56, and 57. The first surfaces 55 are perpendicular to the outer seal portion 52. The first surfaces 55 have truncated ends, which form an open center 58. The second surfaces 56 extend from the sides of the first surfaces 55 at an angle $\alpha_1$ of nearly 90-degrees. The third surfaces 57 are interconnected to the second surfaces 56, and form an angle $\alpha_3$ of approximately 45 degrees with respect to the first surfaces 55. The surfaces are also truncated at the center of the gasket to form roughly a funnel shape which is provided by forming angle $\alpha_2$ (FIG. 2C) at greater than 90 degrees between the first surfaces 55 and the second surfaces 56. The surfaces 55, 56, and 57 form openings 59 about the center 58 that are substantially rectangular. The surfaces 55, 56, and 57 allow the pleated portion 54 and center 58 to expand to allow larger food waste to pass to the disposer 10. The mounting gasket 50 is made of a flexible material such as rubber and, as previously mentioned, serves to retain food waste in the grinding chamber of the disposer 10.

Although the pleated portion 54 of the mounting gasket 50 reduces some of the noise from the disposer 10, it does not reduce all of the noise emanating from the disposer 10 and up into the sink 20. This is due in part to the fact that the mounting gasket 50 has center 58 that allows noise to directly pass through the drain opening 22, as best seen in FIG. 2B. Center 58 becomes more pronounced during operation of the food waste disposer, because even slight pressure on the pleated portion 54 of the gasket 50 (e.g., from the water pressure from the sink) causes the size of center 58 to increase from its resting position.

It has been known in the art to insert a device in the drain opening 22 and to position the device on the mounting gasket 50. Referring to FIG. 3, a perspective view of an insertable device 60 is illustrated in accordance with the prior art. The position of the insertable device 60 on the mounting gasket 50 is illustrated with a dotted line in the FIG. 1. The device 60 includes a cylindrical body 62. A plurality of flaps 70 is flexibly attached to an inner wall of the body 62. Each of the flaps 70 is separated from adjacent flaps by slots 72. A small hole 74 at the end of the slots 72 may help prevent tearing of the material. Each flap 70 contains an opening 76, and each flap 70 includes a curved end, which forms part of a large, central opening 78 through the device 60. The openings 76 in the flaps 70 circumscribe the large, central opening 78 formed by the curved ends.

Neither the conventional mounting gasket 50 nor the insertable device 60 of the prior art are particularly effective in preventing the transfer of noise from the grinding mechanism in the disposer 10 to the sink, although they will reduce the noise to some degree. Although the various structures of the gasket 50 and insertable device 60 do to some extent cover and shield the grinding mechanism, the clear hole through the centers 58 and 78 of both of these devices 50 and 60 allow noise to be directly transferred via the air to the sink 20. Additionally, water flowing into the disposer from the user's faucet, which normally flows during the operation of the disposer, does not act to adequately fill the spaces left by the centers 58 and 78. Instead, water runs almost unencumbered through these centers 58 and 78 and down into the disposer, and hence the water does not act to further shield noise from emanating into the sink.

U.S. patent application Ser. No. 09/997,678, entitled "Food Waste Disposer Having Mechanism and Method For Creating a Water Baffle to Reduce Noise," filed Nov. 29, 2001 by inventor Joseph U. Farmerie, and claiming priority to provisional patent application serial No. 60/253,804, filed Nov. 29, 2000, both of which are assigned to the assignee of the present application and which are incorporated herein by reference in their entireties, discloses a method for creating a water baffle to block the noise of the grinding mechanism. The method disclosed in these applications involves injecting water through a special port on the side of the disposer to create a water dam between the grinding mechanism and the drain opening. In one embodiment in that patent, a diaphragm is placed between the grinding mechanism and the sink to assist in the pooling of water on the diaphragm's surface. However, the diaphragm disclosed in that patent application has a large central opening (see FIG. 8) which would permit noise to flow directly from the grinding mechanism to the drain opening were it not for the creation of the water dam. In other words, the diaphragm disclosed in that patent application requires water introduction, and formation of the water dam, to assist in reducing the noise from the grinding mechanism. Moreover, that patent contemplates the creation of a water dam by virtue of water introduced through a separate inlet into the disposer, which might be unnecessarily complicated or expensive for a given application. A more complete noise-reduction solution, including a solution that would eliminate grinding noise even in the absence of water, or that relies upon the water from the sink's faucet to create a water dam, would be beneficial.

SUMMARY OF THE INVENTION

The present invention provides a baffle for a food waste disposer to reduce noise. The baffle has a diaphragm that allows solid and liquid waste to pass through the diaphragm, and accordingly does not substantially affect the normal operation of the disposer. However, because the baffle substantially covers the central opening of the conventional mounting gasket in the prior art, a direct path from the grinding mechanism in the disposer to the sink is blocked, thus muffling the noise coming from the grinding mechanism. Additionally, the baffles are preferably, but not necessarily, designed to create a water dam on their surface by impeding the flow of water from the sink's faucet in a way to create a pool of water. The disclosed baffles may be installed in the drain opening of a sink above the conventional mounting gasket, making it easy for a consumer to position the baffle in place and to "upgrade" his pre-existing disposer for quieter operation. Additionally, the baffle may be installed below the mounting gasket, or may be integrated with the mounting gasket to form a unitary piece. Furthermore, the disclosed baffle design may obviate the need for a conventional mounting gasket altogether.

BRIEF DESCRIPTION OF THE DRAWINGS

Other objects and advantages of the invention will become apparent upon reading the following detailed description and upon reference to the drawings, in which.

DETAILED DESCRIPTION OF THE INVENTION

In the disclosure that follows, in the interest of clarity, not all features of actual implementations are described. It will of course be appreciated that in the development of any such actual implementation, as in any such project, numerous engineering and design decisions must be made to achieve the developers' specific goals and subgoals (e.g., compliance with mechanical- and business-related constraints), which will vary from one implementation to another. Moreover, attention will necessarily be paid to proper engineering and design practices for the environment in question. It will be appreciated that such a development effort might be complex and time-consuming, but would nevertheless be a routine undertaking for those of skill in the art.

Figure 4:
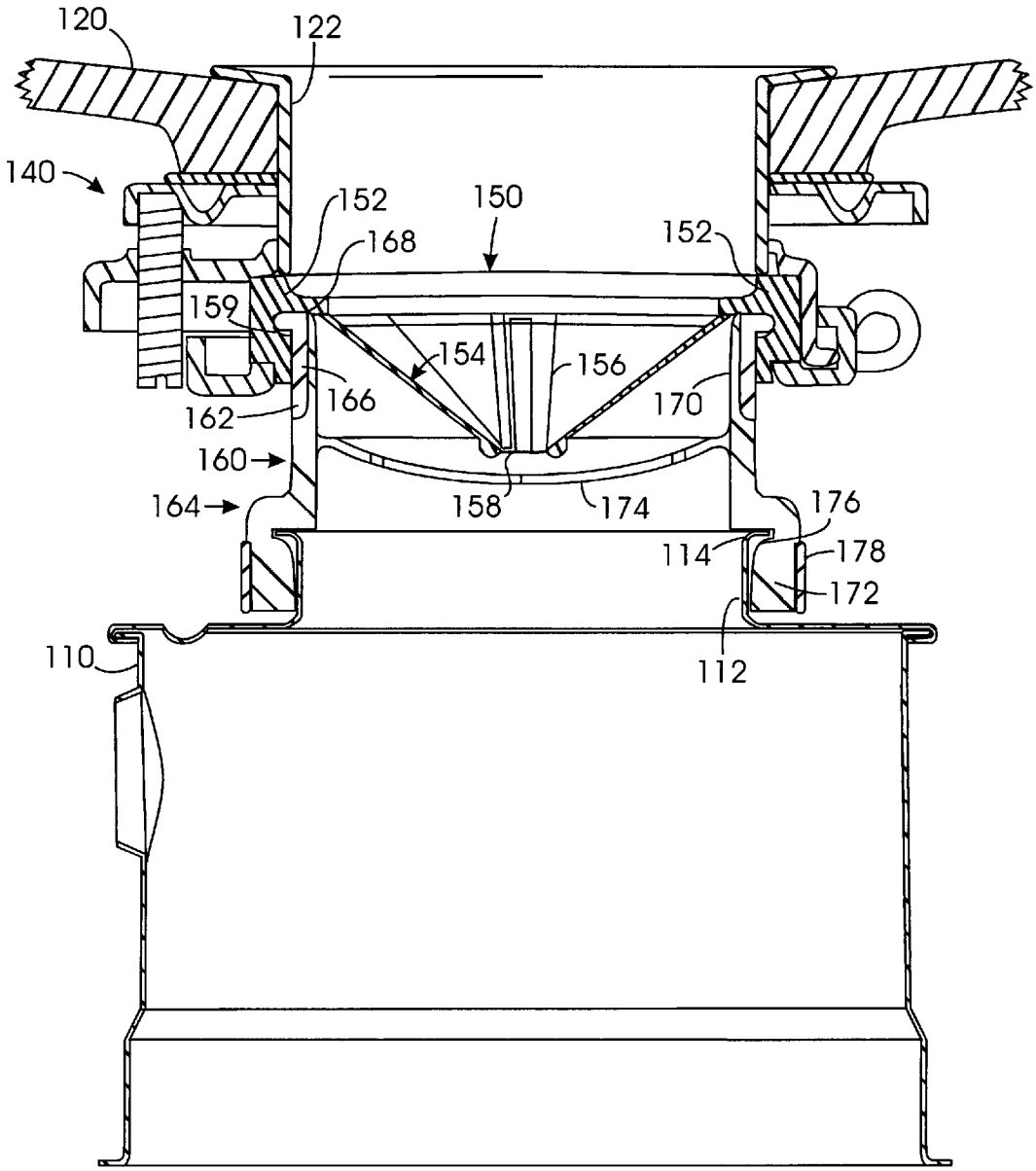
FIG. 4 is a cross-sectional view of a food waste disposer connected to a sink having one embodiment of a baffle according to the present invention.

FIG. 4 depicts the conventional food waste disposer 110 disclosed earlier, but having an inventive baffle 160. As in the prior art, the food waste disposer 110 has an inlet portion 112 connected to a sink 120 and drain opening 122. The inlet portion 112 of the disposer 110 is connected to the sink 120 and drain opening 122 via a connecting apparatus 140, a mounting gasket 150, and the baffle 160, which will be described in more detail herein.

The mounting gasket 150 has an outer seal portion 152 and a pleated portion 154. The outer seal portion 152 provides a seal between the connecting apparatus 140 and the baffle 160. The pleated portion 154 has surfaces 156 and an outlet 158. The surfaces 156 allow the pleated portion 154 and center 158 to expand to allow larger food waste to pass to the disposer 110. As noted earlier, the center 158 of the mounting gasket allows a direct path for noise to emanate from the grinding mechanism in the disposer (not shown) through the sink opening. As noted previously, the mounting gasket 150 is made of a flexible material such as rubber.

In one embodiment, and referring also to FIGS. 5A–5D, the baffle 160 is mounted below the mounting gasket 150 and has a coupling ring 162 and a coupling sleeve 164. The coupling ring 162 has a cylindrical body portion 166 and an outer rim portion 168. The body portion 166 attaches to the coupling sleeve 164. The outer rim portion 168 fits within a groove 159 in the outer seal portion 152 of the mounting gasket 150. The disposer 110 may vibrate during operation. Accordingly, the coupling ring 162 is preferably made of a harder material such as plastic or stainless steel. This allows the outer rim portion 168 to be retained in the groove 159. One suitable plastic material for the coupling ring 162 is polypropylene. Polypropylene is an economical material that offers good physical, chemical, and thermal properties. Polypropylene is highly resistant to organic solvents and degreasing agents. Polypropylene is also lightweight and has a low moisture absorption rate. Stainless steel or other types of corrosion resistant metals may be used. The benefit of stainless steel and other similar metals is that they are typically more durable than plastic and offer similar high resistance to organic solvents and degreasing agents.

The coupling sleeve 164 has a cylindrical upper portion 170, a cylindrical lower portion 172, and a diaphragm portion 174. The upper portion 170 of the coupling sleeve 164 attaches to the coupling ring 162. The lower portion 172 of the coupling sleeve 164 attaches to the inlet portion 112 of the disposer 110. For the attachment, the inlet portion 112 of the disposer 110 has an outer rim portion 114. The outer rim portion 114 fits within an inner groove 176 of the coupling sleeve 164. A clamp 178 may be slid over the lower portion 172 of the coupling sleeve 164 and tightened into place. The clamp 178 provides further support to hold the lower portion 172 of coupling sleeve 164 to the disposer.

The coupling sleeve 164 may be made of a softer material such as rubber. One benefit of using rubber for the coupling sleeve is that it serves as an isolator to reduce structure borne noise that may be caused by the operation of the disposer. In one embodiment, the coupling sleeve 164 is made of Nitrile rubber and the coupling ring 162 is made of stainless steel. Nitrile rubber is very durable and has high solvent resistance. In this embodiment, the coupling ring 162 may be attached to the coupling sleeve 164 by a durable adhesive. In another embodiment, the coupling sleeve 164 is made of Santoprene® thermoplastic rubber and the coupling ring 162 is made of plastic. Santoprene® thermoplastic rubber is very durable and has good resistance to many acids, bases, and aqueous solutions. In this embodiment, the coupling ring 162 may be attached to the coupling sleeve 164 by an over-molding process. During the over-molding process, the plastic coupling ring 162 is placed into position and rubber is shot around the plastic to bond or attach the ring to the coupling sleeve.

Figure 5A:
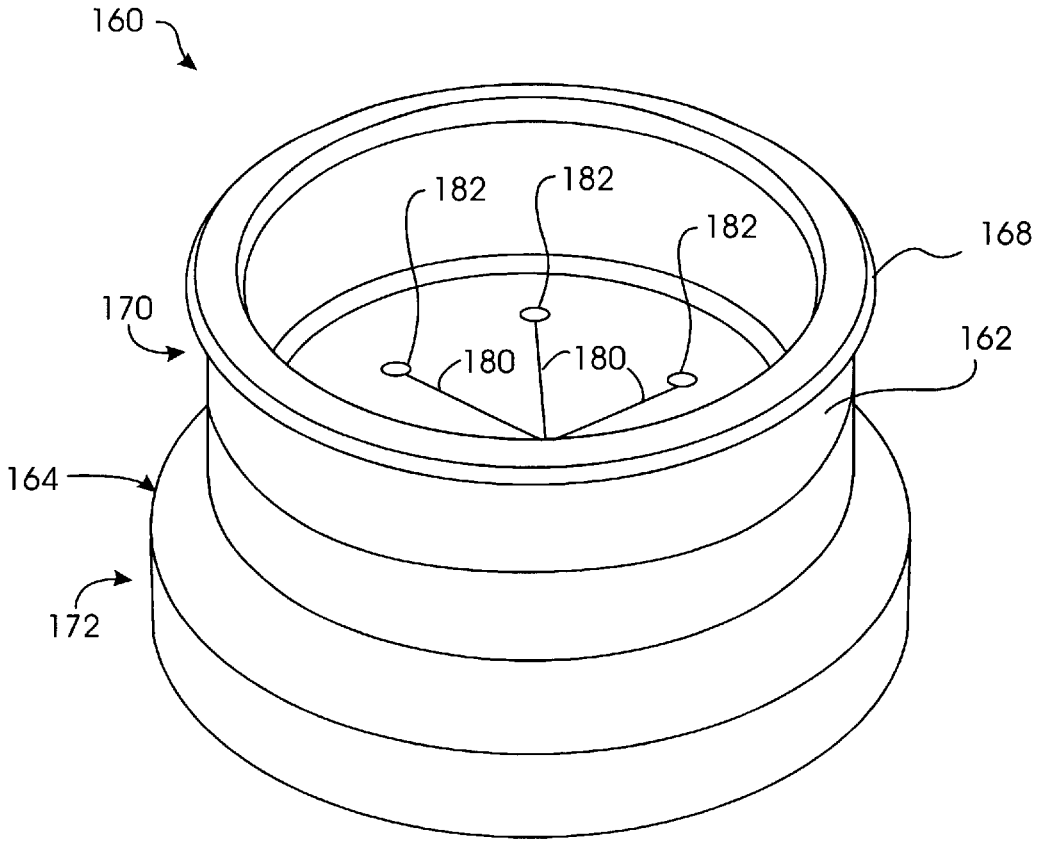
FIGS. 5A–D are respectively a perspective view, a side view, a top view, and a cross-sectional view of the baffle shown in FIG. 4.
Figure 5B:
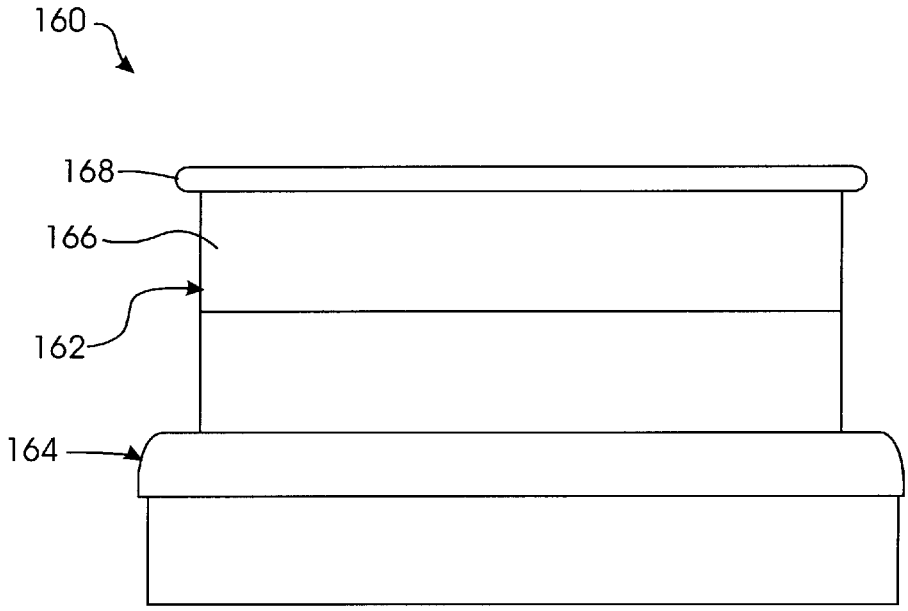
Figure 5C:
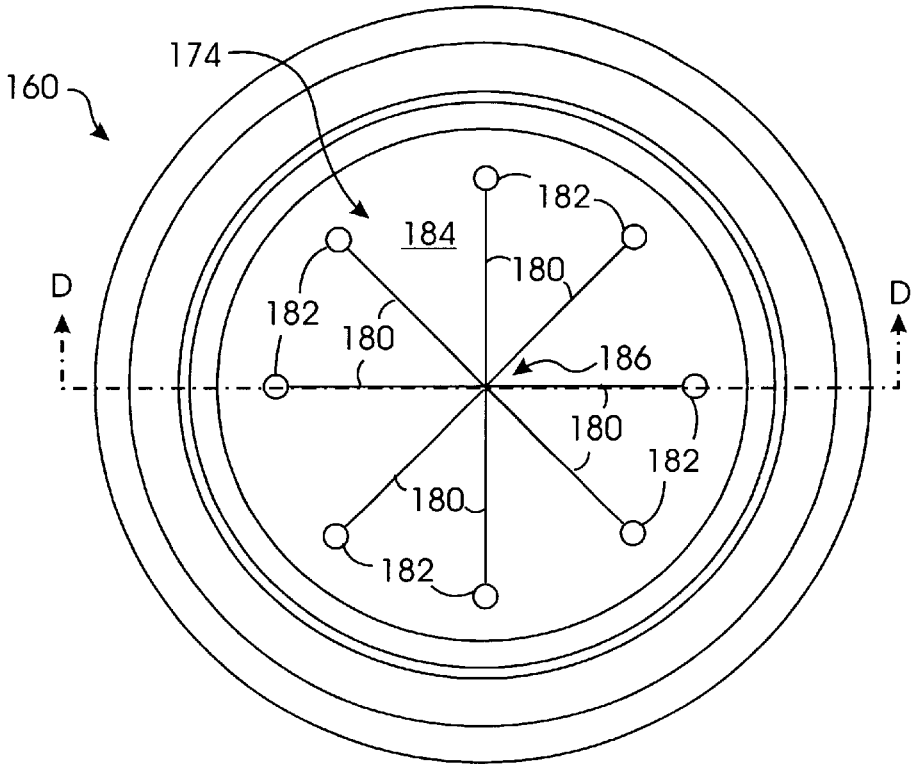

FIGS. 5A–D illustrate different views of the baffle 160 shown in FIG. 4. FIG. 5C shows a top view of one embodiment of the diaphragm portion 174. In this embodiment, the diaphragm portion 174 has a plurality of slots 180. To prevent tearing, each end of the slots 180 has a small hole 182. The slots 180 form a plurality of flaps 184 that allow food waste and eventually water to pass from the drain opening 122 to the grinding mechanism of disposer 110, but which otherwise substantially retains its flat shape when not subjected to the entry of food waste. Each of the flaps 184 includes a tip 186 at the center of the diaphragm portion 174. The tips 186 prevent grinding noise from having a direct, central path through the diaphragm portion 174 to the center of the mounting gasket.

Figure 5D:
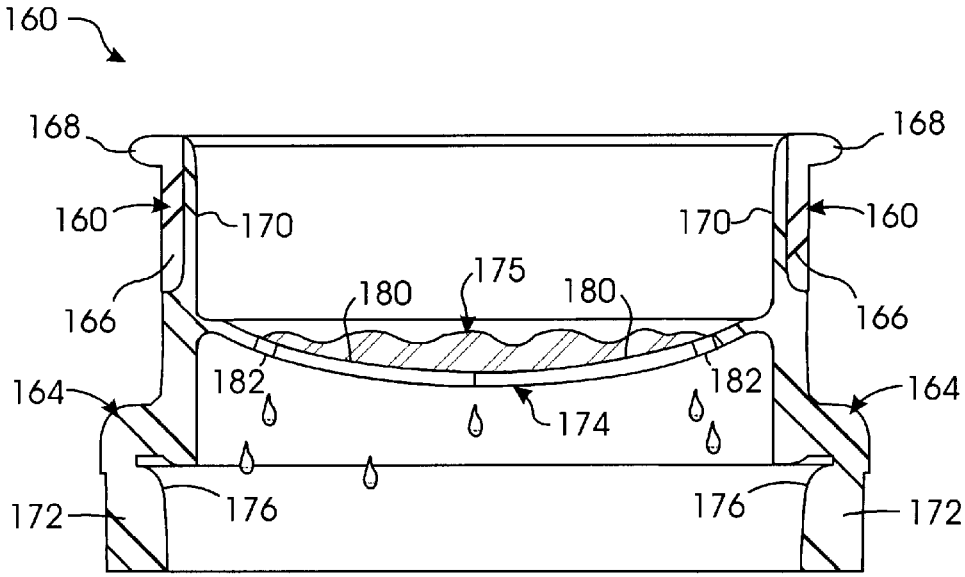

However, additional noise reduction occurs because of the baffle 160's ability to create a water dam on its surface, as is shown in FIG. 5D. As noted earlier, a user typically and preferably runs water from the sink's faucet into the disposer during its operation. While the shape of the baffle 160 allows water to eventually run through the slots 180 and to some extent through the small holes 182, the water flowing onto the diaphragm portion 174 of the baffle will form a pool 175 on the surface of the diaphragm portion 174. Additionally, each of the flaps 184 might be formed with a small hole to help regulate the water flow through the baffle so that a water baffle of adequate size is created, and to prevent the water dam from backing up too far into the drain opening or the disposer. The creation of this pool or water dam 175 helps to create yet another barrier to sound transmission from the grinding mechanism, and thus even further assists in noise reduction.

One skilled in the art will appreciate that the exact structure for the diaphragm portion 174 of the baffle 160 may need to be optimized to properly pool water for a given velocity and volume of water flow coming from the sink's faucet. Thus, the diameters of the small holes 182 might need to be made bigger if too much water pools for a given water flow or be made smaller (or non-existent) if an insufficient amount of water pools. Additionally, the diaphragm portion 174 may need to be made thicker, or of harder material, in a given application to allow the diaphragm portion 174 to better pool water. One of ordinary skill in the art will appreciate that such engineering modifications may be easily made for a given application. When the water and/or the food waste disposer is turned off, the pooled water 175 will eventually drain into the disposer.

Figure 6:
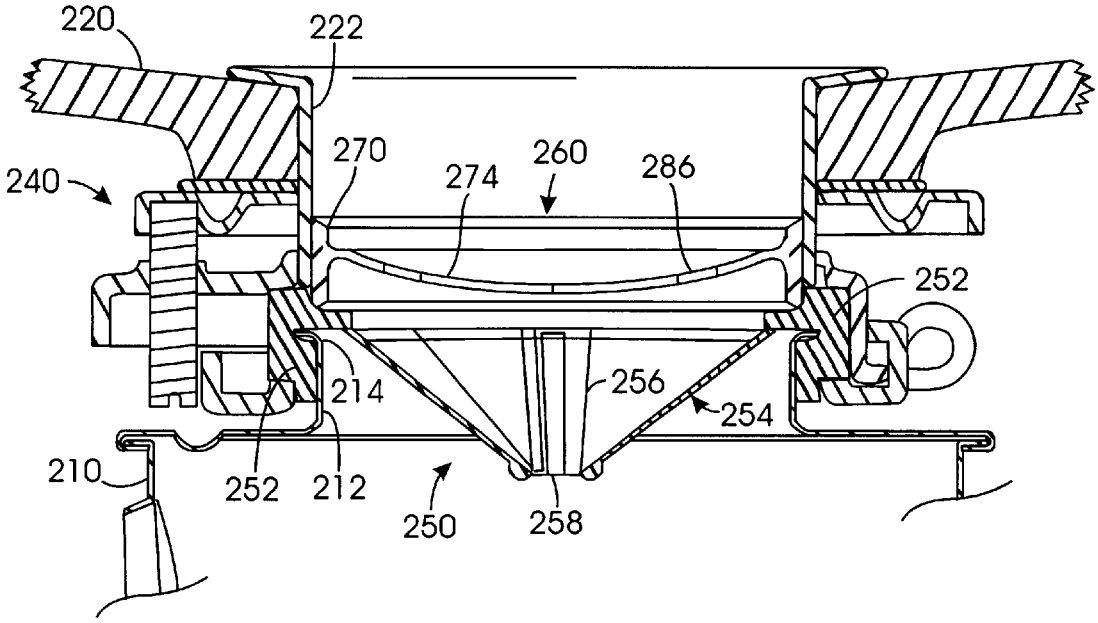
FIG. 6 is a cross-sectional view of a food waste disposer connected to a sink having another embodiment of a baffle according to the present invention.

FIG. 6 depicts another embodiment of a baffle 260, similar to baffle 160. However, unlike baffle 160, baffle 260 is designed to fit within the drain opening 222. Preferably, baffle 260 is designed to slide or press-fit into the drain opening 222 and to rest on the upper surface of a conventional mounting gasket 250 of a conventional food waste disposer 210, whose construction was discussed earlier with reference to the prior art. Optionally, the baffle 260 may be made with an annular rib on its outer surface designed to mate with an annular groove (not shown) on the drain opening 222 so that it may be "clicked" into place.

The embodiment of the insertable baffle 260 is expected to be particularly useful. Such baffles 260 may be purchased by a consumer to "upgrade" their pre-existing disposer to make them run more quietly by simply inserting baffle 260. The "upgrade" can be performed without the need of dismantling or re-installing their disposer or of purchasing a disposer such as that shown in FIG. 4 with the baffle already installed in place.

Figure 7:
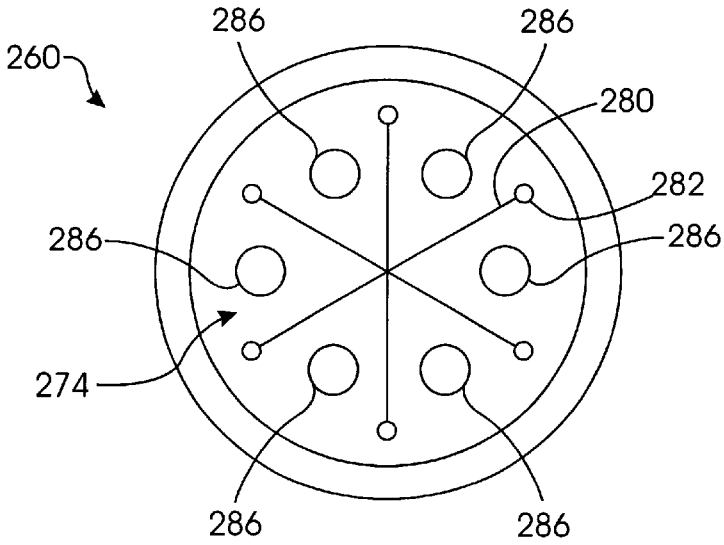
FIG. 7 is a top view of the baffle shown in FIG. 6.

Otherwise, baffle 260 works in much the same fashion as baffle 160 and contains many of the same structures. The baffle 260 may be made of a softer material such as rubber. Suitable materials include Nitrile rubber and Santoprene® thermoplastic rubber. These materials are very durable and have good resistance to many acids, bases, and aqueous solutions. As best shown in the top view of FIG. 7, the baffle 260 contains a cylindrical outer support wall 270, a diaphragm portion 274, slots 280, and small holes 282.

Baffle 260, however, includes additional drain holes 286 specifically designed to regulate the flow of water and to cause an appropriate amount of water to pool on the diaphragm portion 274 of the baffle. As with the embodiment disclosed earlier, the design of baffle 260 provides a solid cover over the center opening 258 of the conventional mounting gasket 250. Thus, the baffle 260 helps to reduce noise coming from the grinding mechanism even in the absence of pooling water on the surface of the diaphragm portion 274. Such pooling, though, is preferable for the added noise reduction properties it provides.

One skilled in the art will appreciate that the diaphragm portions 174 and 274 of the disclosed baffles 160 and 260 may take on many different designs to assist in noise reduction. As discussed previously, important to such designs is the ability to block the direct noise pathway from the grinding mechanism to the sink and/or to allow for the creation of a water dam to further block the noise.

FIGS. 8A–8D disclose another embodiment for a baffle 300 having a diaphragm portion 320, which performs both of these beneficial operations to varying degrees. In FIGS. 8A–8D, the baffle 300 having the diaphragm portion 320 is shown respectively in a top perspective view, a bottom perspective view, a bottom view, and a cross-sectional view.

Figure 8A:
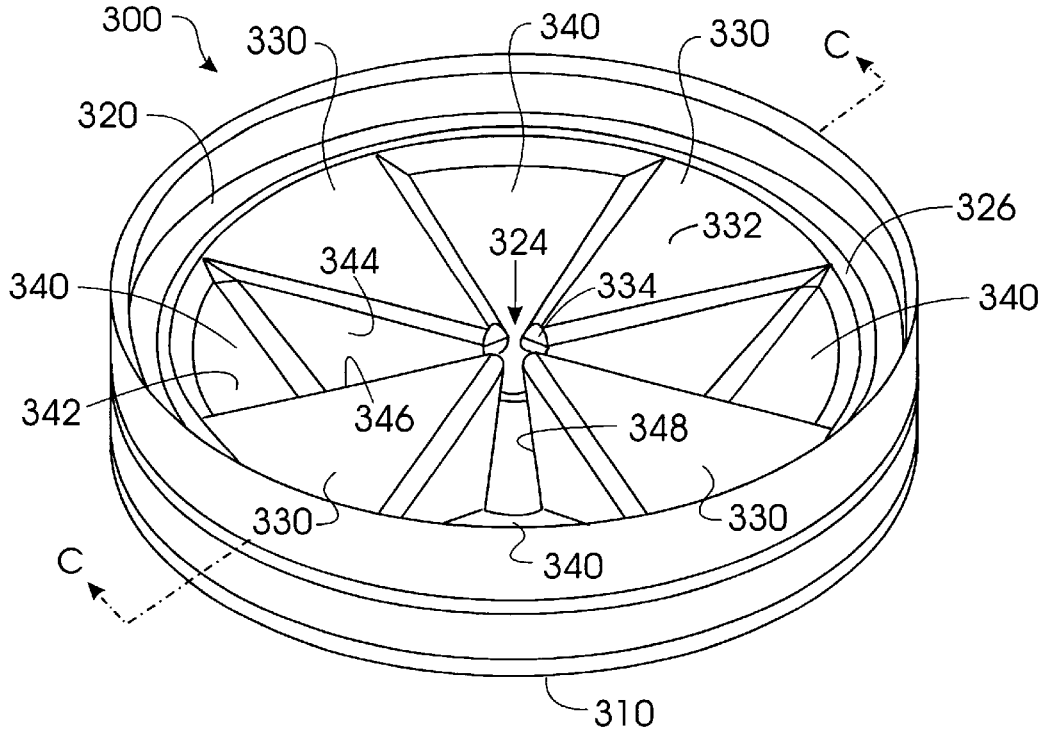
FIGS. 8A–D are respectively a top perspective view, a bottom perspective view, a bottom view and a cross-sectional view of another embodiment of a baffle according to the present invention.
Figure 8B:
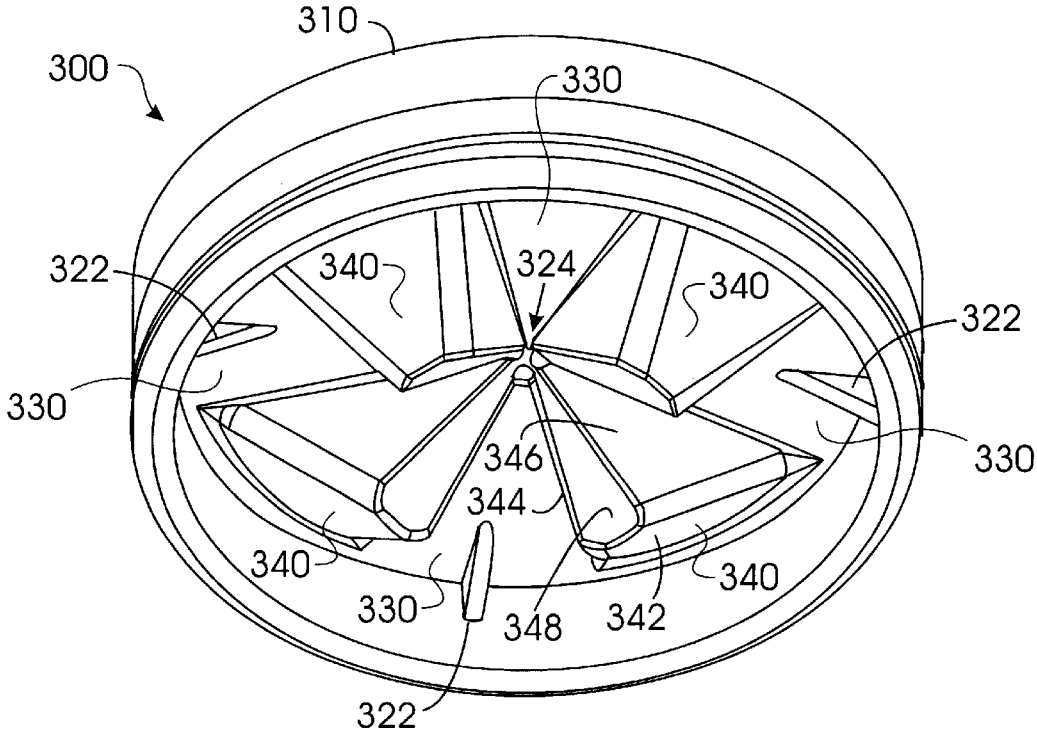
Figure 8C:
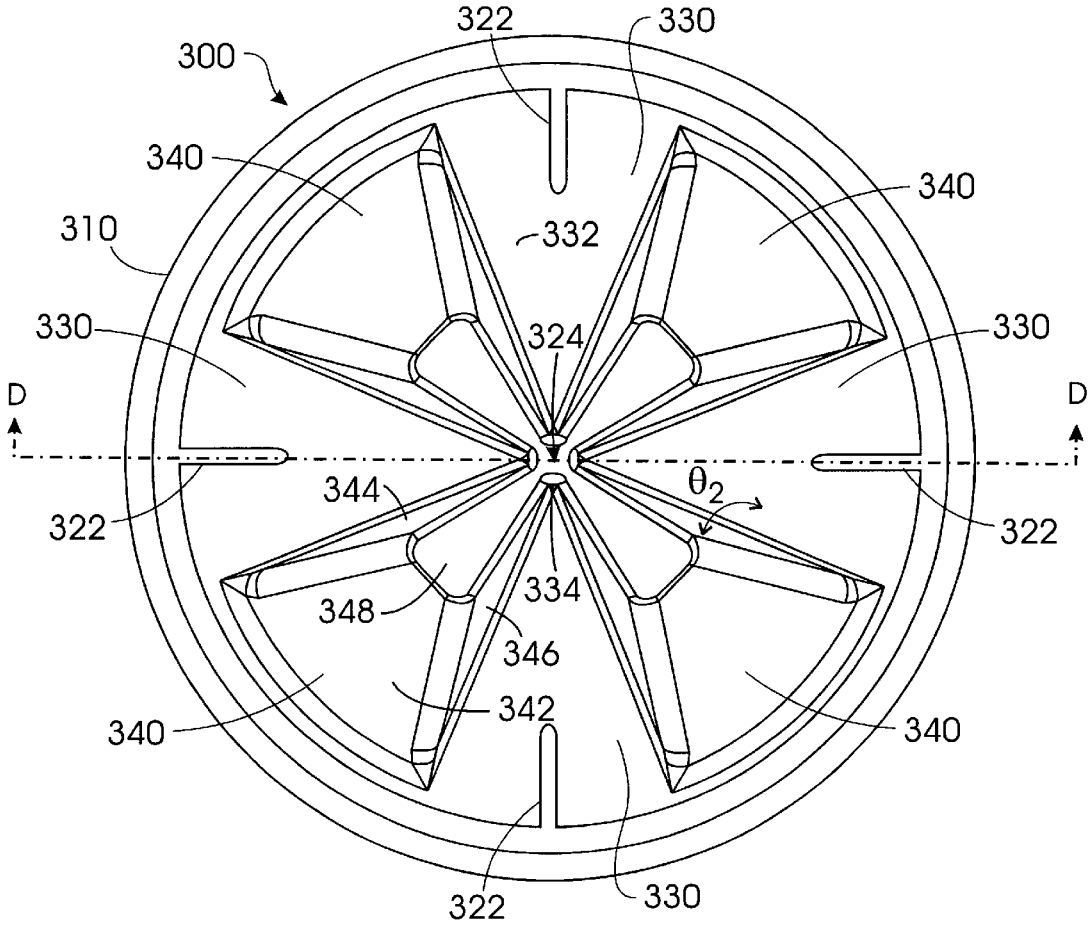
Figure 8D:
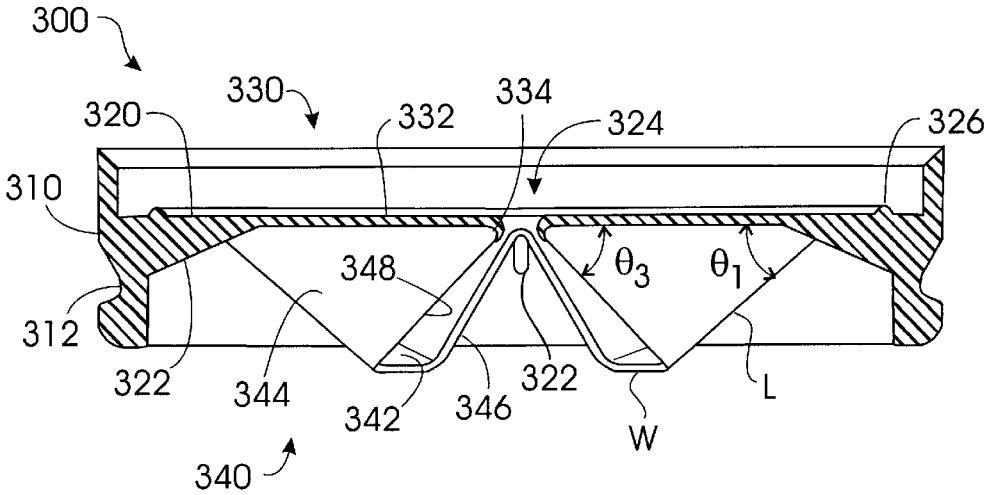
Figure 9:
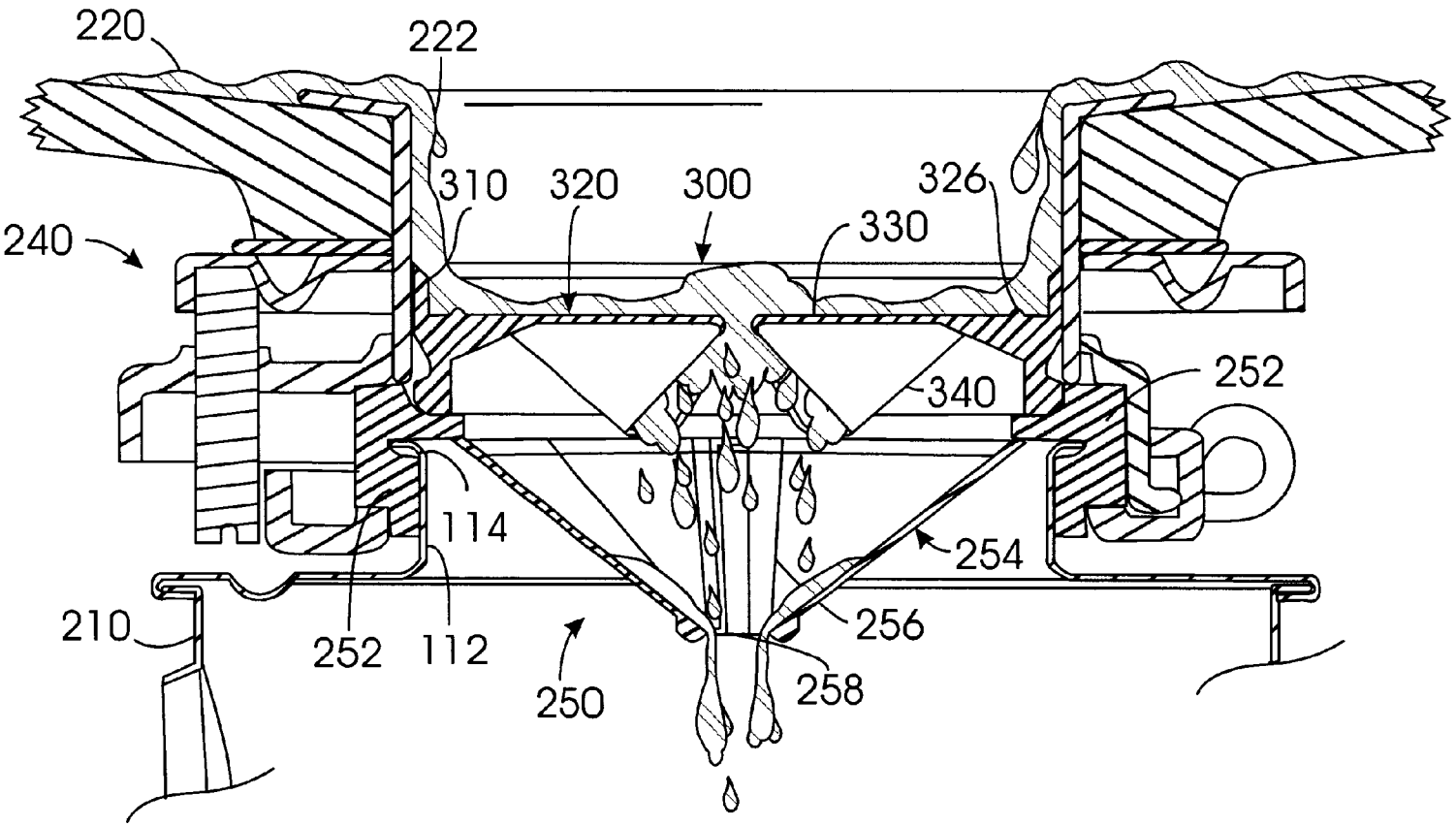
FIG. 9 is a cross-sectional view of a food waste disposer connected to a sink having the baffle of FIGS. 8A–D.
Figure 10:
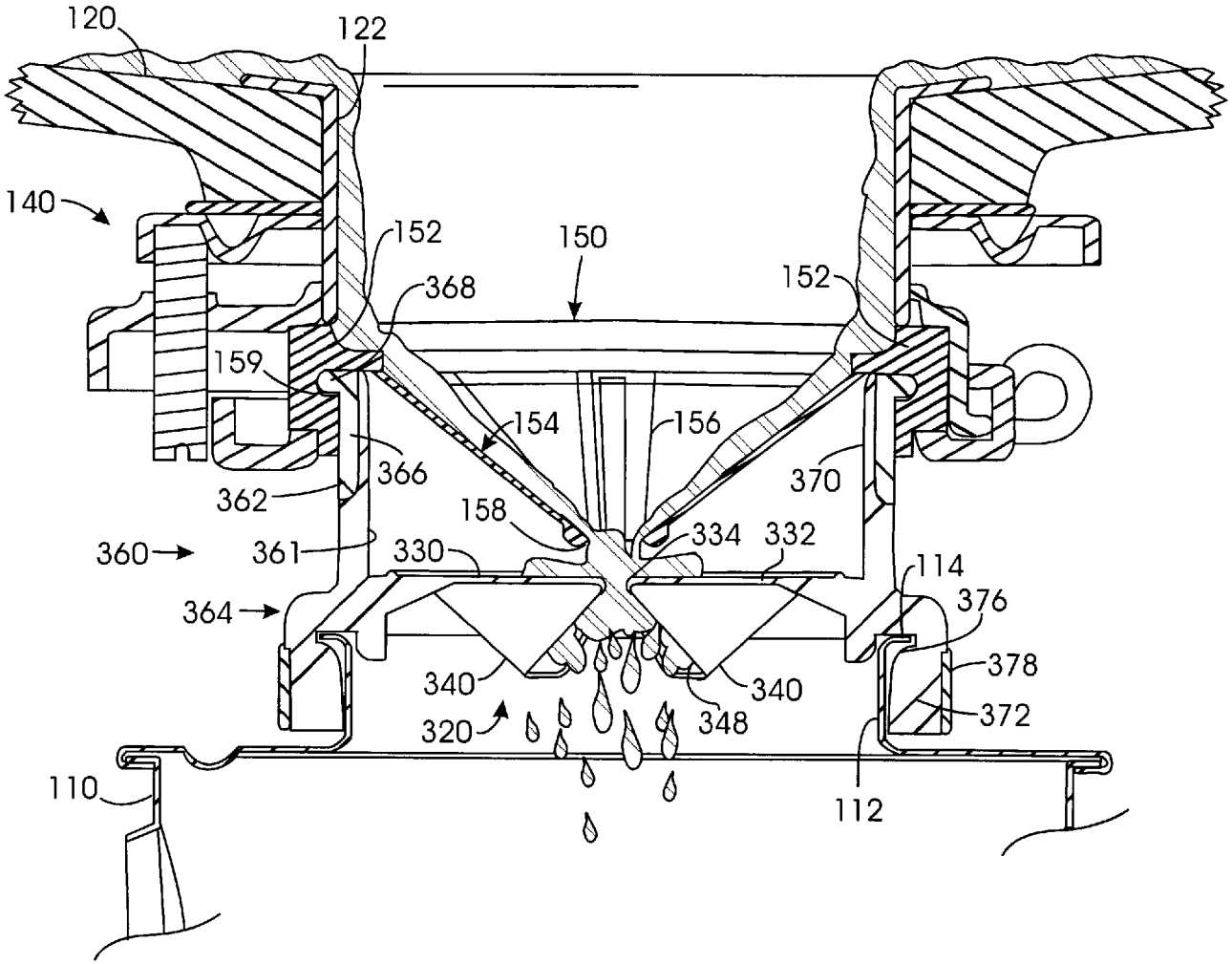
FIG. 10 is a cross-sectional view of a food waste disposer connected to a sink having another embodiment of a baffle according to the present invention.

FIG. 9 shows baffle 300 positioned in the "in the drain opening" configuration. In this respect, baffle 300 of FIG. 9 is similar to the embodiment disclosed with reference to FIG. 6 and its accompanying text, not repeated here, but to which the reader is referred to understand the benefits and construction of this configuration. FIG. 10 shows a baffle 360 having the design of the diaphragm portion 320 of FIGS. 8A–8D. Baffle 360 of FIG. 10 is positioned in the "below the mounting gasket" configuration. In this respect, baffle 300 of FIG. 10 is similar to the embodiment disclosed with reference to FIG. 4 and its accompanying text, not repeated here, but to which the reader is referred to understand the benefits and construction of this configuration.

Baffle 300 of FIGS. 8A–8D includes a support or annular sidewall 310 and the diaphragm portion 320. The sidewall 310 may include an annular groove 312 to facilitate retention of the baffle 300 in a drain opening 222 (see FIG. 9), which may include a complimentary annular rib (not shown) on its inner surface. Alternatively, the sidewall 310 may be sized to press-fit into the drain opening 222. As best shown in FIG. 9, the baffle 300 preferably rests on top of the mounting gasket 250, although this is not strictly necessary.

The diaphragm portion 320 extends across an interior region the baffle 300. The material of the diaphragm portion 320 may have an approximate thickness of 0.035 inches and may be composed of Nitrile rubber or Santoprene® thermoplastic rubber, for example. The diaphragm portion 320 includes a plurality of surfaces 330, which may form a substantially level plane. The plurality of surfaces 330 are separated by and connected to a plurality of pleats 340 hanging or extending from the surfaces 330. In the embodiment illustrated in FIGS. 8A–8D, for example, the diaphragm portion 320 includes four surfaces 330 and four pleats 340.

Each of the surfaces 330 includes a first or level flap 332 flexibly connected to the sidewall 310. Spaced at 90-degree increments about the diaphragm portion 320, each of the first flaps 332 defines an approximately 45 degree sector of the diaphragm portion 320. Each of the first flaps 332 includes a tip or end 334 extending to a central region 324 of the diaphragm portion 320. The tips 334 meet together at the central region 324 and at least partially cover the central region 324. The tips 334 are unattached to one another allowing the central region 324 to be opened with the introduction of food waste. The flaps 332 may bend on the support 310, but are sufficiently resilient or biased enough to remain level when water is run during operation of the food waste disposer.

The hanging pleats 340 are connected to the first flaps 332 and are alternatingly disposed between the first flaps 332 about the central region 324. Each of the hanging pleats 340 also defines an approximately 45 degree sector of the diaphragm portion 320. Each of the hanging pleats 340 includes a second or downward-sloping flap 342 flexibly connected to the support 310. As best shown in FIG. 8D, each of the second flaps 342 preferably defines a first angle $\theta_1$ of approximately 38 degrees with respect to the substantially level plane of the first flaps 332. As best shown in FIG. 8D, the second flaps 342 are preferably approximately 0.875 inches in length (L) and preferably do not extend to the central region 324 of the diaphragm portion 320. The second flaps 342 preferably have a width (W) at their terminations of approximately 0.3125 inches.

A first side fold 344 interconnects the downward-sloping flap 342 to one of the adjacent level flaps 332. A second side fold 346 interconnects the downward-sloping flap 342 to another of the adjacent, level flaps 332. The first and second side folds 344 and 346 preferably define a second angel $\theta_2$ of approximately 100 degrees with respect to the substantially level first flaps 332. The side folds 344 and 346 are wedge-shaped with a wider end adjacent the central region 324 of the diaphragm portion 320. Thereby, each of the hanging pleats 340 forms an opening 348 in the diaphragm portion 320 disposed about the central region 324. The openings 348 have a substantially triangular shape. As best shown in FIG. 8C, each of the openings 348 defines a third angle $\theta_3$ of approximately 50 degrees with respect to the substantially level first flaps 332.

A raised rib 326 may be formed on the top surface of the diaphragm portion 320 circumscribing the integral connection of the flaps 332 and 342 to the sidewall 310. Each of the first flaps 332 may include on its underside a rib or gusset 322 at its connect to the sidewall 310. The gussets 322 help to provide support to the flaps 332 to assist them in remaining level, yet still allow them to bend downward to allow food waste to pass through the diaphragm portion 320. On their tips 334, the first flaps 332 may also include nodules, which may prevent fraying of the diaphragm material. Furthermore, the nodules may provide further coverage of the central region 324 of the diaphragm. The nodules may also interact with one another to maintain the tips 334 of the flaps 332 closed over the central region 324.

As with the embodiments disclosed earlier, the diaphragm portion 320 acts as a physical barrier to grinding-induced noise by virtue of the fact that the first flaps 332 extend substantially to the center 324. This is true whether positioned above the mounting gasket as with baffle 300 in FIG. 9 or below the mounting gasket as with baffle 360 of FIG. 10. Hence, the first flaps 332 at least to some extent cover the open center 158 and 258 of the conventional mounting gasket 150 and 250 (see FIGS. 9 and 10). Therefore, even without the creation of a water dam (discussed in the next paragraph), the diaphragm portion 320 of baffle 300 and 360 acts to muffle noise coming from the disposer.

With respect to reducing noise by covering the open center of the conventional mounting gasket, the particular embodiment of the diaphragm portion 320 of FIGS. 8A–8D may not be as effective as the embodiments of the diaphragm portions 174 and 274 of FIGS. 5A–D and 7, because the diaphragm portions 174 and 274 more substantially or completely cover the center of the mounting gasket and therefore more completely block a direct pathway between the grinding mechanism and the sink. However, the diaphragm portion 320 is presently believed to produce a better water dam than the diaphragm portions of FIGS. 5A–D and 7, and hence has been shown to be particularly useful in reducing grinding noise through its ability to form a water dam under normal conditions of sink faucet operation.

Although the exact way in which this water dam is formed is not completely understood, it is believed that the following occurs. As best shown in FIG. 9, water from the faucet typically runs down the inner wall of the drain opening 222. The water contacts the substantially level first flaps 332 of the diaphragm portion 320. The first flaps 332 remain substantially resilient to the weight of the water. Typically, the water flowing down the drain attempts to form a vortex. The diaphragm portion 320, however, creates turbulence in the water and prevents the formation of a uniform whirlpool. Water is moved along the surfaces of the first flaps 332 to the tips 334 at the center 324, where the water accumulates.

The water from the wall of the drain opening 222 also runs along the downward sloping flaps 346. This water is met by turbulent water cascading from the level surfaces 330 into the pleats 340. This turbulent mixture of water in the pleats 340 ramps towards the openings 348 disposed about the central region 324. The turbulent water rushing down one pleat 340 eventually meets with water coming down an opposing pleat 340, and the effect of the water running off of all the pleats 340 together backs up the water to form a water dam at the bottom of the central region 324 of the diaphragm portion 320. As shown in FIG. 9, at least part of this water dam appears within the pleats 340, but most appears in the bottom of the central region 324 of the diaphragm portion 320 by virtue of the continuous flow of water. In any event, the effect is the creation of a uniform water pool within the central region 324 of the diaphragm portion 320 of baffle 300, wherein this water acts to block the noise of the grinding mechanism from emanating into the sink, thus reducing operative noise.

With the diaphragm portion 320 positioned below the mounting gasket as on baffle 360 of FIG. 10, water from the center 158 of the mounting gasket 150 hits the tips 334 of the flaps 332. The flaps 332 remain substantially resilient to the water pressure. The water experiences turbulence when it hits the tips 334, which causes it to splash and to form bubbles to some degree. The turbulent water eventually runs down from the flaps 332 into the pleats 340. The diaphragm portion 320 on baffle 360 of FIG. 10 positioned below the mounting gasket may then form a water dam in a substantially similar manner as described above, although this particular orientation has not been tested to compare its efficacy with the "in the drain opening" configuration. In any event, the effect is the creation of a uniform water pool within the central region 324 of the diaphragm portion 320 of the baffle 300, wherein this water acts to block the noise of the grinding mechanism from emanating into the sink, thus reducing operative noise.

Of course, one of ordinary skill in the art will recognize that many other diaphragm structures are possible to create water dams or pools that will act to block the direct emanation of noise from the grinding mechanism of the disposer. To cite a simple example, a baffle could be designed with an expandable opening that is off-center but which otherwise covers the center opening in the mounting gasket. Such an off-center opening could be made to form a whirlpool, the wall of which could act as a barrier to operative noise. This simple example merely illustrates that many different baffle designs are possible which will achieve the benefits of the invention as disclosed herein. Moreover, for a given application, the thickness or resilience of the diaphragm portion 320, the number of surfaces 330 or pleats 340, or the size or orientations of the openings 348 may need to be appropriately modified to maintain a sufficient water dam for specific water flows, which might involve normal amounts of experimentation but which is well within the capacity of one skilled in the art.

Figure 1:
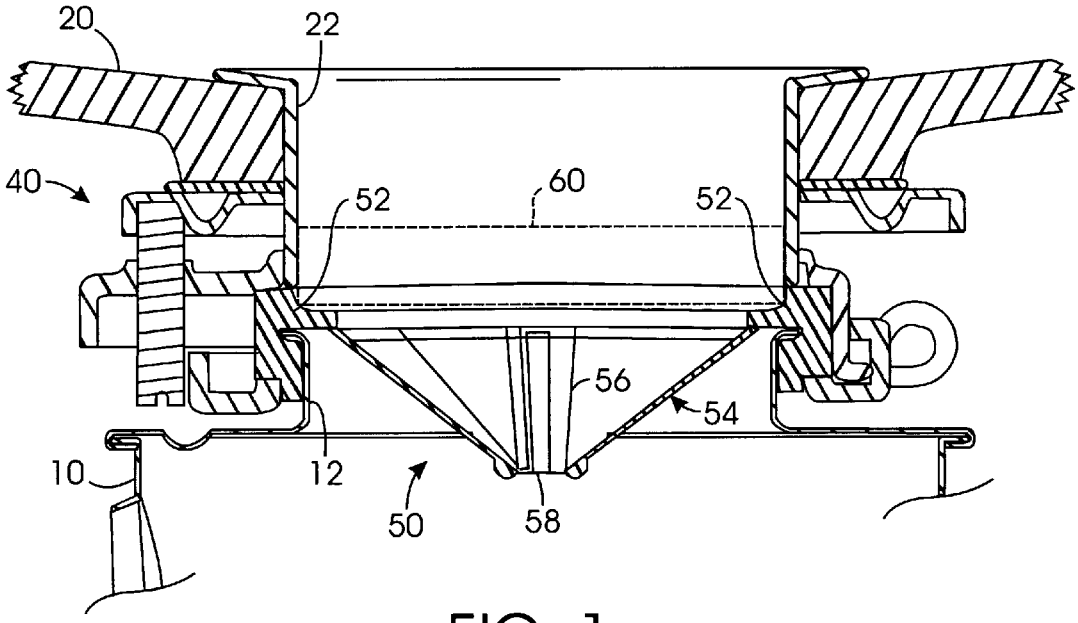
FIG. 1 (Prior Art)
FIG. 1 is a cross-sectional view of the top part of a conventional food waste disposer connected to a sink.
Figure 3:
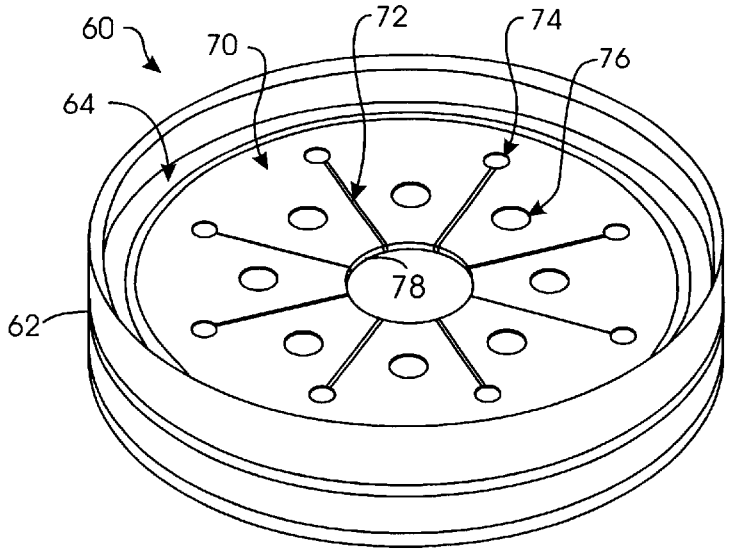
FIG. 3 (Prior Art)
FIG. 3 is a perspective view of a device according to the prior art that is insertable into a drain opening.
Figure 2A:
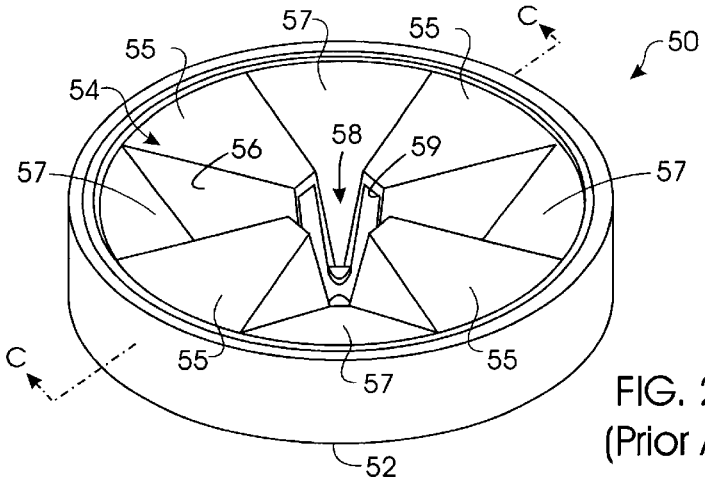
FIG. 2A (Prior Art)
FIGS. 2A–C are respectively a perspective view, a top view, and a cross-sectional view of a conventional mounting gasket for a food waste disposer.
Figure 2B:
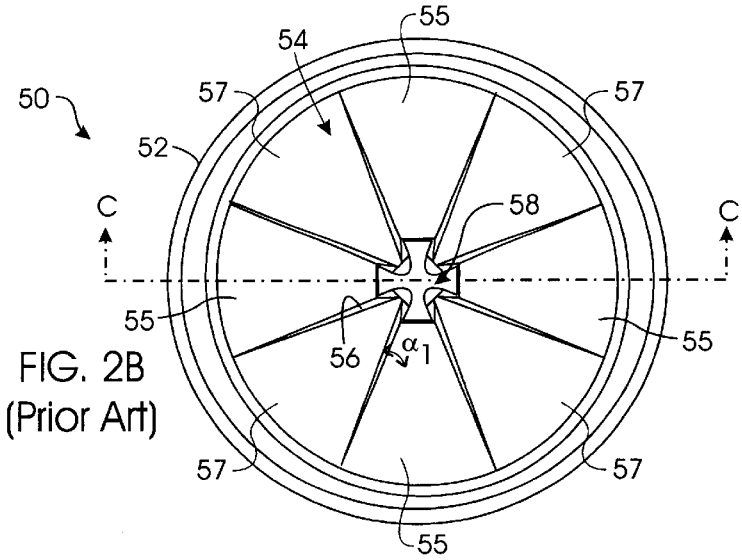
FIG. 2B (Prior Art)
Figure 2C:
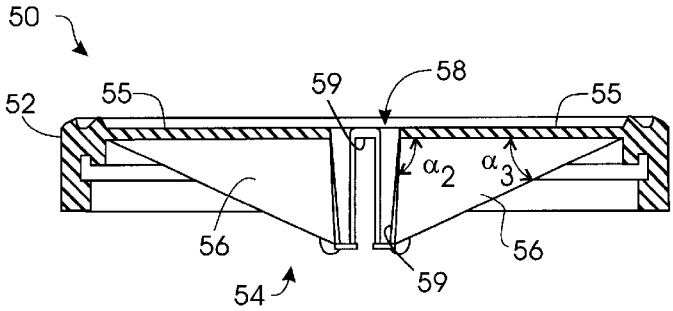
FIG. 2C (Prior Art)

It should also be noted that at first glance the diaphragm portion 320 of FIGS. 8A–D looks similar to the pleated portion of the conventional mounting gasket 50 of FIGS. 2A–C. However, closer inspection shows significant structural and design differences between the two and further shows that the conventional mounting gasket 50 does not operate to form a water dam. First, as noted previously with respect to FIG. 2B, the conventional mounting gasket 50 in its natural state has the center 58 that is naturally open. The center 58 acts to receive and to readily transmit water from a sink faucet to the grinding mechanism of the disposer. The ease with which the water proceeds unencumbered through the mounting gasket 50 is facilitated by the fact that (1) the distal ends of the first surfaces 55 on the mounting gasket 50 do not reach the center 58, (2) even small amounts of pressure on the pleated portion 54 (e.g., from water pressure from stray water in the sink) causes the central opening 58 to open even further to provide an even larger opening for the flow of the water, and (3) the openings 59 are angled such that the flow of water naturally funnels into the disposer (see $\alpha_2$ in FIG. 2C). As previously discussed and as a careful review of the Figures shows, the diaphragm portion 320 does not have these structural features. Accordingly, the diaphragm portion 320 acts to create a water dam under normal water flow rate conditions, while the conventional mounting gasket 50 does not.

Additionally, while the baffles have been disclosed here as separate components within the disposer, one skilled in the art will recognize that the baffle could easily be integrated with other components of the disposer. For example, for both the "in the drain opening" configuration of FIGS. 6 and 9 and the "below the mounting gasket" configuration of FIGS. 4 and 10, the baffle could easy be integrated with the mounting gasket, and possibly with other connecting components of the disposer. However, it is presently preferred that the baffle be manufactured as a separate piece and thereafter placed into position within the disposer. This is especially true for the "in the drain opening" configuration where it is believed that consumers will benefit from the ability to insert or remove the baffles at their leisure.

Furthermore, the disclosed water damming baffles could in a particular application be used in place of the conventional mounting gasket. In this regard, the disclosed baffles, perhaps with some obvious modification, could easily be able to perform the functions of a mounting gasket, including providing a place to mount the disposer, providing a structure to absorb vibrations from the grinding mechanism, and preventing the "kicking up" of food into the sink. Such a modification is possible by redesigning the pleated portion of the conventional mounting gasket and replacing the same with one of the disclosed baffle diaphragm designs, and/or lengthening the annular support to provide additional elastic material to absorb vibrations. In short, the disclosed baffles could essentially take the place of the conventional mounting gasket in a disposer, while providing the capability of water damming to prevent a direct noise path from the grinding mechanism in the disposer to the sink.

While the present invention has been described with respect to particular embodiments, one should not understand these embodiments to limit the scope of the various aspects of the invention, which instead is defined by the below claim language and its equivalents.

What is claimed is:

1. A baffle for reducing noise emanating from a grinding mechanism of a food waste disposer, wherein the food waste disposer is connectable to a drain opening of a sink, the baffle comprising:

a diaphragm extending inwards from a sidewall, wherein the diaphragm (i) substantially covers the center of the drain opening; and (ii) comprises a pleated structure including a circumferentially alternating plurality of first flaps and second flaps, wherein the first flaps comprise tips substantially meeting in the center of the baffle, and wherein the second flaps form a baffle opening directed into the drain.

2. The baffle of claim 1, wherein the baffle is made of rubber.

3. The baffle of claim 1, wherein the sidewall is sized to fit into the drain opening.

4. The baffle of claim 1, wherein the baffle is positionable above a mounting gasket disposed between the disposer and the drain opening.

5. The baffle of claim 4, wherein the baffle is positionable on a mounting gasket disposed between the disposer and the drain opening.

6. The baffle of claim 1, wherein the baffle is positionable below a mounting gasket disposed between the disposer and the drain opening.

7. The baffle of claim 6, wherein the sidewall comprises:

a first portion connectable to the drain opening; and a second portion connectable to an inlet portion of the food waste disposer.

8. The baffle of claim 7, wherein the first portion is comprised of metal and the second portion is formed of rubber.

9. The baffle of claim 8, wherein the first portion and second portions are attached by an adhesive.

10. The baffle of claim 1, wherein the diaphragm is capable of allowing waste to pass from the sink to the grinding mechanism.

11. The baffle of claim 1, wherein the diaphragm is capable of a water dam substantially blocking a noise path from the grinding mechanism to the opening.

12. The baffle of claim 1, wherein the baffle opening comprises a plurality of downwardly angled slots.

13. The baffle of claim 1, wherein the first flaps are substantially horizontal.

14. A food waste disposer, comprising:

a grinding mechanism;

a mounting gasket positioned over the grinding mechanism and connectable to a first drain opening of a sink, the mounting gasket containing a second opening which is smaller that the first drain opening; and a baffle separate from the mounting gasket comprising a diaphragm extending inwards from a sidewall, wherein the diaphragm (i) is capable of allowing waste to pass from the sink to the grinding mechanism, (ii) is positioned to substantially block the second opening, and (iii) is further capable of pooling water from the sink on its surface.

15. The food waste disposer of claim 14, wherein the diaphragm comprises a plurality of flaps.

16. The food waste disposer of claim 15, wherein the plurality of flaps is formed by a plurality of slots defined in the diaphragm.

17. The food waste disposer of claim 14, wherein the baffle is made of rubber.

18. The food waste disposer of claim 14, wherein the diaphragm comprises a pleated structure.

19. The food waste disposer of claim 18, wherein the pleated structure includes a circumferentially alternating plurality of first flaps and second flaps, wherein the first flaps are substantially horizontal and comprise tips substantially meeting in the center of the baffle, and wherein the second flaps form a baffle opening directed into the drain at a downward angle.

20. The food waste disposer of claim 19, wherein the second flaps define a third opening at a bottom end of the baffle.

21. The food waste disposer of claim 20, wherein the diaphragm is further capable of pooling water from the sink at the third opening.

22. The food waste disposer of claim 14, wherein the diaphragm is configured to pool the water such that the pooled water substantially blocks a direct noise path from the grinding mechanism to the first drain opening through the second opening.

23. The food waste disposer of claim 14, wherein the baffle is positioned between the mounting gasket and the grinding mechanism.

24. The food waste disposer of claim 23, wherein the sidewall comprises:

a first portion connectable to the mounting gasket; and a second portion connectable to an inlet portion of the food waste disposer.

25. The food waste disposer of claim 24, wherein the first portion is comprised of metal and the second portion is formed of rubber.

26. A food waste disposer connectable to a drain opening, comprising:

a grinding mechanism;

a baffle positioned over the grinding mechanism, the baffle comprising a diaphragm extending inwards from a sidewall, wherein the diaphragm (i) substantially covers the center of the drain opening; and (ii) comprises a pleated structure including a circumferentially alternating plurality of first flaps and second flaps, wherein the first flaps comprise tips substantially meeting in the center of the baffle, and wherein the second flaps form a baffle opening directed into the drain.

27. The food waste disposer of claim 26, wherein the diaphragm is capable of forming a water dam substantially blocking a noise path from the grinding mechanism to the drain opening.

28. The food waste disposer of claim 26, wherein the baffle opening comprises a plurality of downwardly-angled slots.

29. The food waste disposer of claim 26, wherein the first flaps are substantially horizontal.

30. The food waste disposer of claim 26, wherein the baffle is made of rubber.

31. The food waste disposer of claim 26, wherein the sidewall comprises:

a first portion connectable to the mounting gasket; and a second portion connectable to an inlet portion of the food waste disposer.

32. The food waste disposer of claim 31, wherein the first portion is comprised of metal and the second portion is formed of rubber.

33. The food waste disposer of claim 26, wherein the diaphragm is capable of allowing waste to pass from the sink to the grinding mechanism.

* * * * *

UNITED STATES PATENT AND TRADEMARK OFFICE

CERTIFICATE OF CORRECTION

PATENT NO. : 6,719,228 B2
DATED : April 13, 2004
INVENTOR(S) : Berger et al.

It is certified that error appears in the above-identified patent and that said Letters Patent is hereby corrected as shown below:

Column 11,
Lines 1-3, should read as follows:

11. The baffle of claim 1, wherein the diaphragm is capable of forming a water dam substantially blocking a noise path from the grinding mechanism to the drain opening.

Signed and Sealed this

Twenty-seventh Day of July, 2004

JON W. DUDAS
*Acting Director of the United States Patent and Trademark Office*